United States Patent [19]

Silverberg

[11] Patent Number: 4,946,049

[45] Date of Patent: Aug. 7, 1990

[54] TIE DISPLAY ASSEMBLY

[75] Inventor: Harry G. Silverberg, Glencoe, Ill.

[73] Assignee: Bigsby & Kruthers, Inc., Chicago, Ill.

[21] Appl. No.: 405,663

[22] Filed: Sep. 8, 1989

[51] Int. Cl.[5] ..... A47F 5/00

[52] U.S. Cl. ..... 211/87; 211/94

[58] Field of Search ..... 211/87, 94, 204, 208, 211/60.1, 162, 113

[56] References Cited

U.S. PATENT DOCUMENTS

| | | | |
|---|---|---|---|
| 240,807 | 5/1881 | Beneke | 211/204 X |
| 1,530,612 | 3/1925 | Pelzer | 211/60.12 |
| 4,037,729 | 7/1977 | De Sisto | 211/208 |
| 4,253,578 | 3/1981 | Rekow | 211/204 X |
| 4,813,552 | 3/1989 | Walter | 211/204 X |

*Primary Examiner*—Alvin C. Chin-Shue
*Assistant Examiner*—Sarah A. Lechok
*Attorney, Agent, or Firm*—Mark I. Feldman

[57] ABSTRACT

An aesthetically pleasing tie display is provided with a set of special, removable, interchangeable tie-support devices to attractively display different ties in a retail clothing store or the like. Each of the tie-support devices has a special channel member for removable attachment to a clothes rod and has a tie-support bar comprising an angled finger to efficiently carry, support, and display a tie in an attractive manner.

12 Claims, 2 Drawing Sheets

TIE DISPLAY ASSEMBLY

BACKGROUND OF THE INVENTION

This invention pertains to display equipment and, more particularly, to an apparatus for displaying neckties in clothing stores and the like.

Over the years men's clothing ties (neckties) have been displayed in many ways. Ties have been draped, adorned, and tied about the necks of mannequins in conjunction with a dress shirt, suit or sports coat. This is an attractive way for the customer to visualize how the tie looks and an appealing way to show the customer how the tie can be worn in conjunction with other clothes offered for sale in the store. Unfortunately, mannequins take up (occupy) a lot of space and, therefore, not many ties can be displayed in the store in this manner, especially in the tie department whose space is limited and often at a premium.

Glass display cases are sometimes used to display ties in stores. In such cases, the ties are typically placed and displayed horizontally on shelves, in a side-by-side, overlapping or spread out manner. This can be attractive, but the display often quickly becomes messy, sloppy, untidy, and unappealing once a clerk or customer without being extremely careful, has gone through the pile of ties and removed two or more of the ties for a closer examination and/or purchase. Also, ties placed and shown on lower shelves are often not readily seen.

Ties draped on plastic tie hangers on rods or clothing racks are convenient ways to hang ties in a compact manner as well as a simple way to remove ties and show price information, brand name, or other indicia. Plastic tie hangers, however, are terrible displays since only the end ties can be viewed by customers standing away from the rack.

Another method which has been used to display ties are peg boards with hooks. This can be useful but is often not very aesthetic, especially when the holes and hooks of the peg board are in clear view of the customer.

Tie racks with fixed nails or pegs have also been used to display ties. Such fixed tie racks can be helpful but are not very attractive when the bare nails or pegs can be seen or when large gaps appear between the ties after some of the ties are removed and or purchased.

Tie racks with pivotable arms from which ties are hung are somewhat more utilitarian and convenient. Pivotable tie racks can be an eyesore, however, if too many of the bare pivotable arms are viewable or large gaps between ties appear when ties are removed.

It is therefore, desirable to provide an improved display apparatus for displaying ties which overcomes most, if not all, of the preceding problems.

SUMMARY OF THE INVENTION

An improved apparatus, device, and assembly is provided for attractively displaying neckties in clothing stores and the like. Advantageously, the improved apparatus, device, and assembly is aesthetically pleasing, easy to use, and compact. It is also convenient, economical, and effective. Desirably, the novel apparatus, device, and assembly can be readily installed, assembled, and removed.

To this end, the novel apparatus, device, and assembly has a tie-support member, such as in the form of a bar or straight finger to support a clothing tie (necktie) in a substantially upright position from a position in proximity to a horizontal hanging clothes rod, and has a carrying member, such as a generally n-shaped module or channel, which is securely connected to the tie-support member for removable attachment (releasable engagement) to the hanging clothes rod. The tie-support member (bar) is stationary and extends forwardly at an angle of inclination less than 90 degrees, most preferably about 30 degrees, relative to the hanging clothes rod to enhance the overall appearance and maximum number of ties which can be effectively displayed in a specific space (display area). The tie-support member (bar) can also have a rectangular cross-section to minimize slippage and movement of the tie displayed thereon. In the preferred form, the tie-support member (bar) is positioned above the rod to elevate and display a portion of the tie above the rod.

Advantageously, the rod-engaging carrying member (module or channel) has a stabilizing portion or lip to minimize tilting, turning, and rotation on the rod and prevent the tie and support device (module) from falling off the rod.

A more detailed explanation of the invention is provided in the following description and claims taken in conjunction with the accompanying drawings.

DETAILED DESCRIPTION OF THE PREFERRED EMBODIMENT

Figure 1:
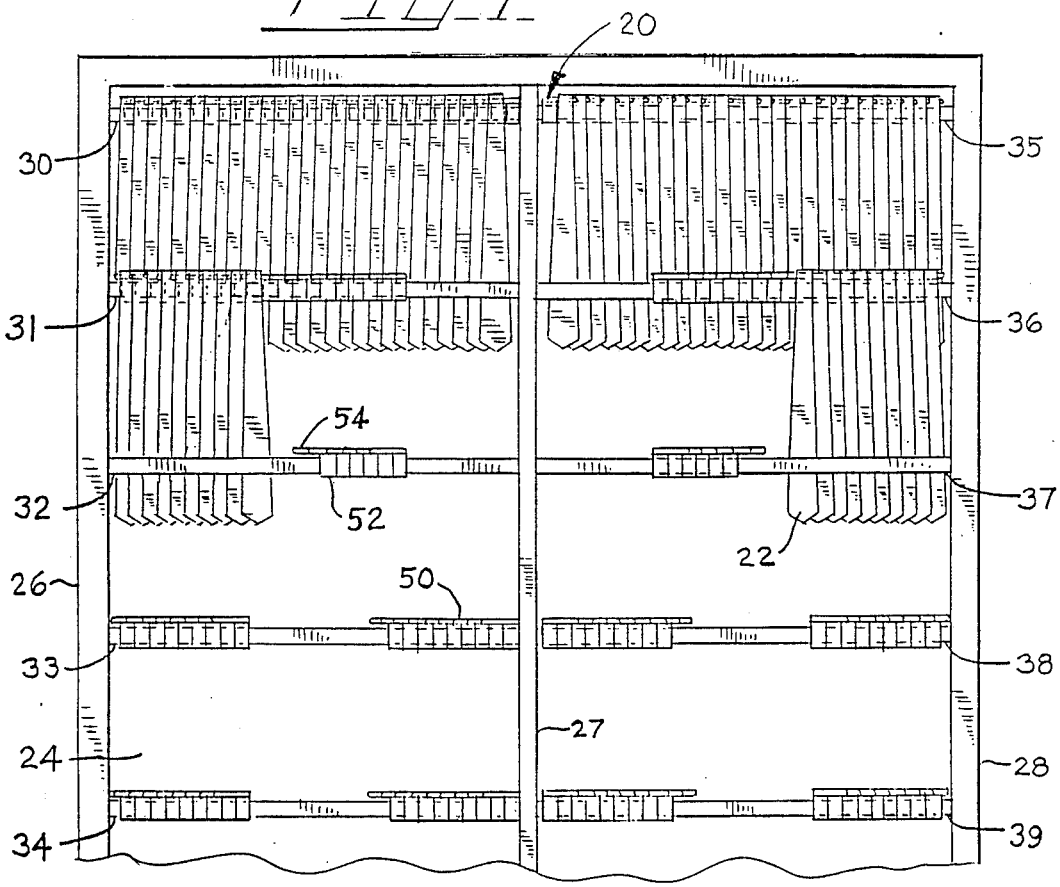
FIG. 1 is a reduced perspective view of a part of a tie display in accordance with principle of the present invention.

The inventive tie display 20 as shown in the drawings provides an efficient, handy, display device, apparatus, assembly and unit to attractively show and aesthetically display a large number of neckties 22, particularly men's clothing ties in a clothing store or clothing section of a department store or other retail store, etc.

In the illustrative tie display 20 (FIG. 1) the display 20 is constructed in association with upright vertical walls including a back wall 24 and parallel side walls 26–28 which extend forwardly from the back wall. If desired, the walls can also be formed from a wall display case with the back (rear) panel providing the back wall and side wall members providing the side walls.

Figure 2:
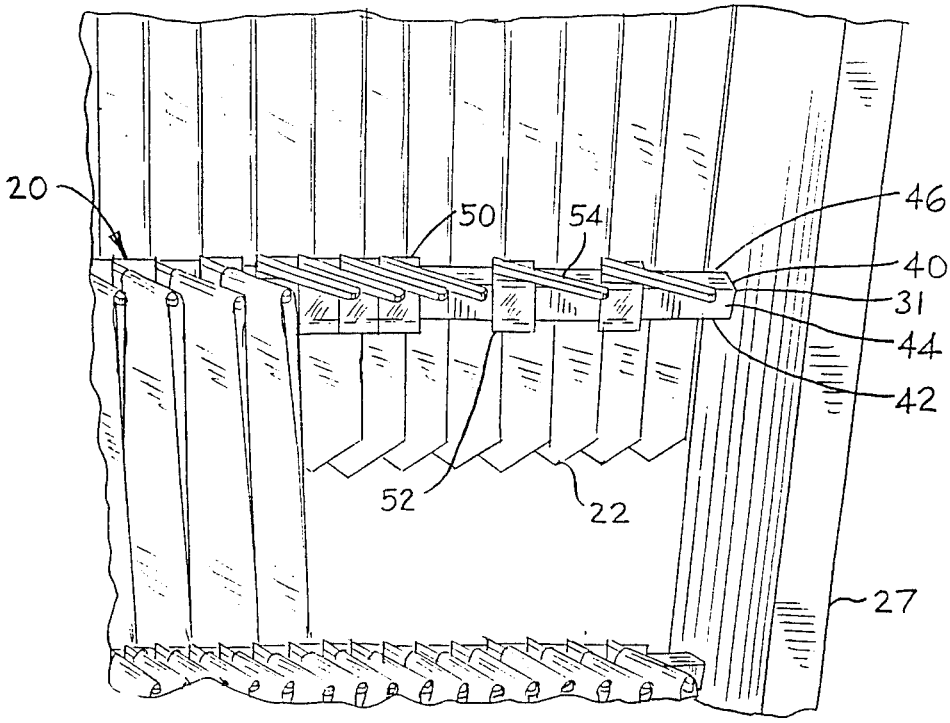
FIG. 2 is a perspective view of part of the tie display.
Figure 3:
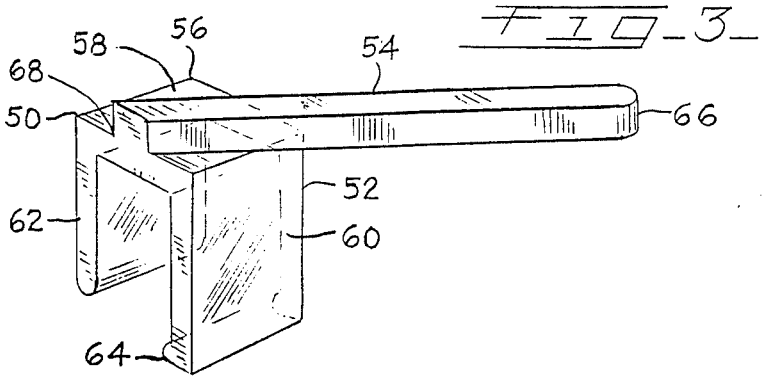
FIG. 3 is an enlarged perspective view of a tie-support device.
Figure 4:
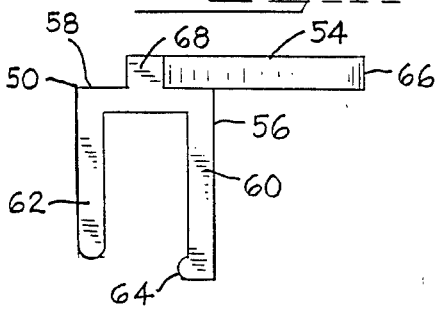
FIG. 4 is a side view of the tie-support device.
Figure 5:
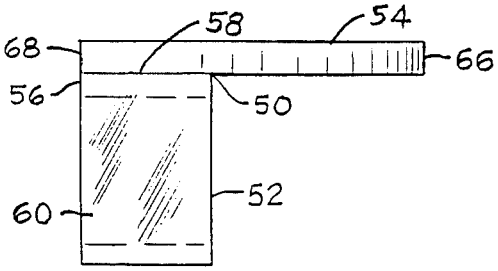
FIG. 5 is a front view of the tie-support device.
Figure 6:
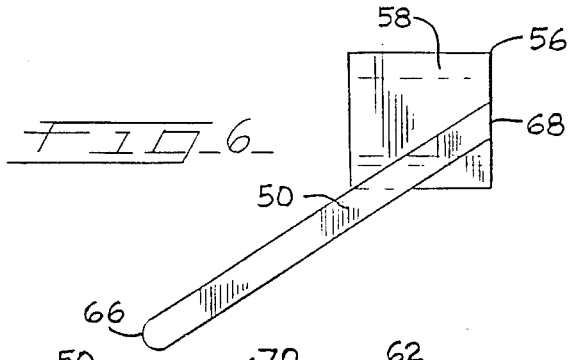
FIG. 6 is a top view of the tie-support device.

Tiers and rows of elongated metal or wooden support bars 30–39 (FIG. 1) comprise symmetrical arrays of rectangular hanging clothes rods which extend horizontally between and are fastened or otherwise fixedly connected and mounted to the side walls 26–28. The arrays of rods 30–39 are spaced forwardly of the back wall 24 and are positioned at different heights (levels) with the lower rods being progressively and sequentially disposed forwardly of the upper rods to enhance the display of neckties 22. Each of the rectangular rods 31 (FIG. 2) has a top portion 40, bottom portion 42, front portion 44, and back (rear) portion 46.

Figure 7:
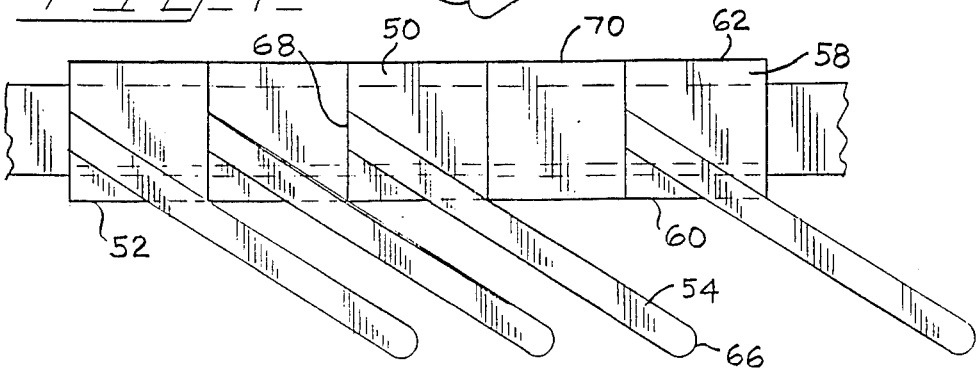
FIG. 7 is a top view of a set of tie-support devices and a spacer.

In order to aesthetically display and remove ties, interchangeable, removable, snap-fitting, tie-supporting modules 50 (FIGS. 1, 2, and 7) are detachably connected (removably attached) and supported on the rods 30–39. The modules 50 desirably comprise sets of complementary tie-support members or devices (necktie supporting devices) positioned side-by-side on the rods 30–39. In the illustrative embodiment, the tie-support devices 50 are transparent and made of impact-resistant flexible plastic. Other materials such as wood, metal, or rubber can be used, if desired.

As best shown in FIGS. 3–6, each of the tie-support devices 50 has a channel-shaped rod-engaging carrying member 52 and a tie-support member or bar 54 from which the tie hangs. The channel-shaped rod-engaging member 52 comprises a n-shaped or inverted U-shaped channel or saddle 56 which sits upon, snugly engages, and slides along one of the hanging clothes rods. The channel (saddle) 56 has a flat or planar rectangular top 58, comprising a bight, and has downwardly depending legs 60 and 62 which extend vertically downwardly from the bight to a position in proximity to the bottom portion of the clothes rod. The legs 60 and 62 can comprise flat or planar rectangular, abutment, clamping legs and include a front leg 60 for positioning adjacent the front portion of the clothes rod and a back (rear) leg 62 for positioning adjacent the back portion of the clothes rod. The legs 60 and 62 are spaced from each other a minimum distance slightly greater than the exterior width (distance) between the front and back portions 44 and 46 of the clothes rod. The lower portion (bottom section) of the front leg 60 comprises a J-shaped lip 64 which provides a rearwardly extending stabilizing member to abut against and compressively engage the bottom portion of the clothes rod so as to effectively minimize and substantially prevent the module (tie-support device) 50 from tilting, rotating, turning, and falling off the clothes rod.

The tie-support member (bar) 54 (FIGS. 2–7) provides a stationary, elongated, straight, rigid finger which is securely and fixedly connected to and cantilevered from the bight or top portion 58 of the channel 56. The tie-support member (bar or finger) 54 is longer than the width of the front leg 60 and extends horizontally forwardly and laterally from a front corner of the bight or top portion 58 of the channel 56 for a distance at least as great as the width of the neck portion of the tie. The free end or tip 66 of the tie-support member 54 is rounded to prevent tearing the ties. The attached end 68 of the tie-support member is angled (inclined) so as to be flush with the edge of the top 58 of the channel 56. In order to support and display the neckties in an aesthetically pleasing manner, the tie-support member (bar or finger) 54 extends forwardly at an angle of inclination less than 90 degrees, preferably between 15 degrees and 75 degrees, and most preferably about 30 degrees, relative to the front leg 60 and horizontal axis of the clothes rod. The tie-support member (bar or finger) 54 can also have a rectangular cross section to minimize slippage and movement of the necktie being displayed thereon.

In one display, the tie-display devices 50 had a tie-support member (bar or finger) 54 of about $2\frac{1}{2}$ inches long and front and back legs 60 and 62 about $\frac{7}{8}$ inches wide. For an attractive overall appearance all the tie-support members (fingers) 54 on a clothes rod were positioned left to right or right to left in the same direction.

In use, the tie-display devices 50 are inserted on the clothes rod and slid towards each other so as to be positioned generally side-by-side. Different ties are hung and draped from the tie-support members (bars or fingers) 54 so that each tie-support member displays and supports a different tie. Preferably, there are no naked tie-support members (bars or fingers) 54 without ties hung therefrom. When a customer desires to select, closely examine, or purchase a tie, the tie and its associated tie-display device 50 are removed from the clothes rod and the remaining tie-display device are slid together to leave no gap therebetween.

If desired, a spacer comprising a blank display device or spacer module 70 (FIG. 7), which is identical to the channel 56 but has no tie-support member (bar or finger), can be inserted in the gap on the clothes rod in lieu of a removed tie display device.

Among the many advantages of the novel tie display are:

1. An outstanding, neat overall appearance.
2. A superior aesthetically pleasing display.
3. Excellent appeal to customers.
4. Convenient and inviting.
5. Easy to use.
6. Relatively simple to install.
7. Commercially attractive.
8. Economical
9. Maximizes display space.
10. Safe
11. Efficient
12. Effective Although embodiments of the invention has been shown and described, it is to be understood that various modifications and substitutions, as well as rearrangements of parts, can be made by those skilled in the art without departing from the novel spirit and scope of this invention.

What is claimed is:

1. A tie display assembly, comprising:

a tie-support means comprising an elongated tie-supporting finger for supporting a clothing tie in a substantially upright position from a location positioned above and in proximity to a substantially horizontal hanging clothes rod; and carrying means comprising an inverted substantially U-shaped saddle connected to said finger for sitting upon, releasably engaging, and sliding along said clothes rod, said saddle having a top comprising a bight positioned upon said clothes rod and having downwardly depending legs including a front leg and a back leg extending downwardly from said bight; and said tie-supporting finger fixedly connected to and cantilevered from said bight at an elevation spaced above said legs.

2. A tie display assembly in accordance with claim 1 wherein said finger has a substantially rectangular cross-section to minimize slippage of said tie.

3. A tie display assembly in accordance with claim 1 wherein said finger is positioned at an angle of inclination relative to said rod.

4. A tie display assembly in accordance with claim 1 wherein said front leg has a bottom section with a substantially J-shaped lip comprising a rearwardly extending stabilizing member for substantially preventing tilting, turning, and rotation of said inverted U-shaped saddle on said clothes rod.

5. A tie display assembly, comprising:

a wall display having a back wall and substantially parallel upright side walls extending forwardly from said back wall;

tiers of elongated support bars comprising symmetrical arrays of substantially rectangular rods extending substantially horizontally between and connected to said upright walls, said arrays of rods being spaced forwardly of said back wall and positioned at different heights with lower rods being progressively and sequentially disposed forwardly of upper rods for enhancing the display of neckties, each of said rectangular rods having a top portion, a bottom portion, a front portion, and a back portion;

interchangeable, removable tie-supporting modules detachably connected and supported on said rods for displaying said neckties, said modules comprising sets of complementary tie-support devices for positioning substantially side-by-side on each of said rods, each of said tie-support devices having a channel-shaped rod-engaging member comprising an inverted U-shaped saddle for sitting upon, snugly engaging and sliding along one of said rods, said saddle having a substantially planar rectangular top comprising a substantially horizontal bight and having downwardly depending legs extending substantially vertically downwardly from said bight to a position in proximity to the bottom portion of said rod, said legs comprising substantially planar, rectangular abutment clamping legs including a front leg positioned adjacent said front portion of said rod and a back leg positioned adjacent said back portion of said rod, said front leg having a bottom section with a substantially J-shaped lip comprising a rearwardly extending stabilizing member for abuttingly engaging part of the bottom portion of said rod to substantially prevent said module from tilting and falling off said rod, said tie-support device providing a tie-support member and comprising a stationary elongated substantially rigid finger fixedly connected to and cantilevered from said bight to a position forwardly of said front leg, and said finger being disposed at an angle of inclination relative to said front leg and said rod for supporting and displaying a necktie in an aesthetically pleasing manner.

6. A tie display assembly in accordance with claim 5 wherein said legs are each about 1 inch wide.

7. A tie display assembly in accordance with claim 5 wherein said finger is substantially straight and substantially longer than the width of said front leg.

8. A tie display assembly in accordance with claim 5 wherein said finger is substantially rectangular.

9. A tie display assembly in accordance with claim 5 wherein said finger extends forwardly and laterally from a corner of said top of said module for a distance at least as great as a portion of the width of a necktie.

10. A tie display assembly in accordance with claim 5 wherein said modules further includes a spacer module, and said spacer modules are structurally similar to said tie-support devices in the absence of said finger.

11. A tie display assembly in accordance with claim 5 wherein said angle of inclination of said finger ranges from about 15 degrees relative to said front leg to about 75 degrees.

12. A tie display assembly in accordance with claim 11 wherein said angle of inclination of said finger is about 30 degrees relative to said front leg.

* * * * *